US009990847B2

(12) United States Patent
Kim et al.

(10) Patent No.: US 9,990,847 B2
(45) Date of Patent: Jun. 5, 2018

(54) TRAFFIC ACCIDENT OCCURRENCE NOTIFICATION SYSTEM USING LED DISPLAY LAMPS

(71) Applicant: KMW INC., Hwaseong, Gyeonggi-do (KR)

(72) Inventors: Duk-Yong Kim, Gyeonggi-do (KR); Yoon-Bae Lee, Gyeonggi-do (KR); Seok Sung, Gyeonggi-do (KR); Tai-Woo Lee, Gyeonggi-do (KR); Jong-Hun Lee, Seoul (KR); Min-Soo Kim, Gyeonggi-do (KR); Dong-Sik Roh, Seoul (KR)

(73) Assignee: Gigatera INC., Hwaseong (KR)

( * ) Notice: Subject to any disclaimer, the term of this patent is extended or adjusted under 35 U.S.C. 154(b) by 0 days. days.

(21) Appl. No.: 15/368,867

(22) Filed: Dec. 5, 2016

(65) Prior Publication Data

US 2017/0084173 A1 Mar. 23, 2017

Related U.S. Application Data

(63) Continuation of application No. PCT/KR2015/005413, filed on May 29, 2015.

(30) Foreign Application Priority Data

Jun. 3, 2014 (KR) ..... 10-2014-0067810

(51) Int. Cl.
*G08G 1/00* (2006.01)
*G08G 1/095* (2006.01)
(Continued)

(52) U.S. Cl.
CPC ..... *G08G 1/095* (2013.01); *G08G 1/09* (2013.01); *G08G 1/16* (2013.01)

(58) Field of Classification Search
CPC ..... G08G 1/095; G08G 1/09; G08G 1/16
(Continued)

(56) References Cited

U.S. PATENT DOCUMENTS

2014/0335897 A1* 11/2014 Clem ..... G08G 1/0112 455/456.3

FOREIGN PATENT DOCUMENTS

JP 2004-027528 A 1/2004
KR 10-2009-0059343 A 6/2009
(Continued)

*Primary Examiner* — George Bugg
*Assistant Examiner* — Anthony D Afrifa-Kyei
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a traffic accident occurrence notification system using LED display lamps, comprising: an emergency message generating unit provided in a mobile means so as to generate a wireless signal in an emergency situation; a plurality of LED display lamps provided together with street lamps provided on a road so as to receive the wireless signal from the emergency message generating unit and display a turned-on or flickering state from a position at which the wireless signal is received to a position at which a distance is set at a rear; and a street lamp control server for controlling the street lamps and the LED display lamps and determining the position at which the wireless signal is received so as to transmit information thereof to a rescue server. The present invention provides the emergency message generating unit in a vehicle so as to detect an accident or enable a driver to recognize an emergency situation and select propagation of the emergency situation, and enables a nearby street lamp to receive the wireless signal when the emergency message generating unit transmits the wireless signal so as to turn on or flicker the LED display lamps such that the LED display lamps located at the
(Continued)

rear of a distance set at a corresponding position are turned on or flicker so as to make a driver in a rearward vehicle recognize the occurrence of the emergency situation ahead, thereby preventing the occurrence of a secondary collision accident.

5 Claims, 5 Drawing Sheets

(51) Int. Cl.
*G08G 1/09* (2006.01)
*G08G 1/16* (2006.01)

(58) Field of Classification Search
USPC ..... 340/928, 932, 901, 907, 903, 902, 908, 340/909, 917, 425.5, 426.15, 426.16, 340/426.17, 500, 488
See application file for complete search history.

(56) References Cited

FOREIGN PATENT DOCUMENTS

| | | | | |
|---|---|---|---|---|
| KR | 10-2011-0057868 | A | 6/2011 | |
| KR | 10-2012-0114591 | A | 10/2012 | |
| KR | 10-1245510 | B1 | 3/2013 | |
| KR | WO 2013032267 | A1 * | 3/2013 | ..... G08G 1/096716 |
| WO | 2013/032267 | A1 | 3/2013 | |

* cited by examiner

TRAFFIC ACCIDENT OCCURRENCE NOTIFICATION SYSTEM USING LED DISPLAY LAMPS

CROSS REFERENCE TO RELATED APPLICATIONS

This application is a continuation of an International Application No. PCT/KR2015/005413 filed on May 29, 2015, which claims priority to Korean Patent Application No. 10-2014-0067810 filed on Jun. 3, 2014, the entire disclosures of which are incorporated herein by reference.

TECHNICAL FIELD

The present disclosure relates to a traffic accident occurrence notification system that uses LED indicating lamps. More particularly, the present disclosure relates to a traffic accident occurrence notification system using LED indicating lamps in which the traffic accident occurrence notification system is provided in a vehicle so as to propagate an accident signal therearound upon detecting an accident or according to a user's selection, and is able to notify rearward vehicles of the occurrence of a traffic accident at a corresponding position by using an LED indicating lamp that is separately provided in a street lamp.

BACKGROUND ART

A vehicle, which is driven on a highway, usually travels at a high speed that exceeds 100 km/hour. Thus, when the vehicle continuously travels because the driver of the vehicle does not recognize that an accident has occurred ahead, it is highly possible that a secondary collision occurs in which the vehicle rear-ends a stopped accident vehicle.

In particular, the view is less clear in a very foggy day or at night. Thus, in some cases, even if the traveling speed is reduced after recognizing that the accident vehicle has occurred ahead, it may be difficult to avoid a second collision due to the increase of the braking distance when the traveling speed of the vehicle is high.

In addition, even in the day time when the view is clear, a secondary collision may be caused on a curved road or the like because it is difficult to determine an accident situation.

Due to the reasons described above, very big accidents, such as chain collisions involving ten or more vehicles, have frequently occurred on highways. However, no means for preventing such a chain collision has been provided up to now.

Further, while a vehicle travels on a highway, a delayed or congested section may suddenly occur in a specific zone. Even without an accident situation, a collision accident may occur when the view is less clear because it may not be recognized that there is a delayed or congested section.

When traveling at a high speed on a highway, a driver may feel sleepy due to the monotony of traveling. According to official statistics, 75% of vehicle drivers who travel on a highway feel sleepy within 90 minutes after starting driving. This is because the drivers are in a state in which the ability to recognize the peripheral situation is reduced compared to the usual condition. As a sign of sleepiness, the ability to recognize the speed of the forward vehicle is reduced even though the drivers do not fall asleep.

When a vehicle, which has traveled in a smoothly flowing section, suddenly encounters a delayed or congested section, it may rear end a forward vehicle by failing to reduce the speed.

Even in a case where a traffic accident has occurred similarly to this, secondary accidents may occur in which the rearward vehicles rear end the accident vehicle because the rearward vehicles travel without recognizing the fact that the traffic accident has occurred ahead, but the accident vehicle remains in the stopped state on the road due to the traffic accident.

In consideration of the problems described above, Korean Patent Laid-Open Publication No. 10-2012-0114591 in the name of the applicant of the present application (published on Oct. 17, 2012) discloses a technology in which a camera is installed on a street lamp to determine whether a congestion or an accident occurs, and when it is determined that an accident occurs, a warning is given to the rearward vehicles by causing street lamps therearound to flicker.

Such a configuration is useful for a method of determining a situation of a road and propagating the situation. However, what is demanded in the market is a method that is inexpensive and efficient as compared to a method of causing all the street lamps to flicker.

In addition, because the determination as to whether an accident occurs is made based on an image captured by a camera installed on the road, there is a possibility that an error occurs in determining the accident. Further, because it is difficult to determine an exceptional situation other than an obvious accident, such as temporal stopping according to a driver's poor health or the like, it is demanded to implement a system that is capable of coping with various situations.

SUMMARY

The present disclosure was made in consideration of the market's demand as described above, and an object of the present disclosure is to provide a traffic accident occurrence notification system using LED indicating lamps in which the traffic accident occurrence notification system is capable of notifying that a vehicle accident or an emergency situation has occurred through a button provided within a vehicle, and is able to propagate it through an LED indicating lamp provided on a road.

In addition, the present disclosure is to provide a traffic accident occurrence notification system using LED indicating lamps in which a separate LED indicating lamp, which is excellent in visibility, is added rather than using the flickering of street lamps as in the prior art, such that it is possible to more efficiently propagate the fact that an emergency situation has occurred ahead.

Further, the present disclosure is to provide a traffic accident occurrence notification system using LED indicating lamps in which, upon detecting an emergency situation or according to a driver's direct selection, the traffic accident occurrence notification system is capable of notifying rearward that an accident has occurred from the position of the corresponding vehicle such that the drivers of the rearward vehicles can sufficiently reduce the speeds of the vehicles in advance, thereby preventing the occurrence of a large accident by a chain collision.

In order to solve the above-described problems, the present disclosure provides a traffic accident occurrence notification system that uses LED indicating lamps. The system includes: an emergency message generating unit that is provided in a mobile means to generate a wireless signal in an emergency situation; a plurality of LED indicating lamps, which are provided together with street lamps provided on a road, to receive the wireless signal from the emergency message generating unit, and to indicate a turned-on or flickering state within a distance that is set rearward from a position where the wireless signal is received; and a street lamp control server that controls the street lamps and the LED indicating lamps, and determines a position where the wireless signal is received so as to transmit information thereof to a rescue server.

DETAILED DESCRIPTION

Hereinafter, embodiments for a traffic accident occurrence notification system using an LED indicating lamp according to the present disclosure will be described in detail with reference to the accompanying drawings.

Figure 1:
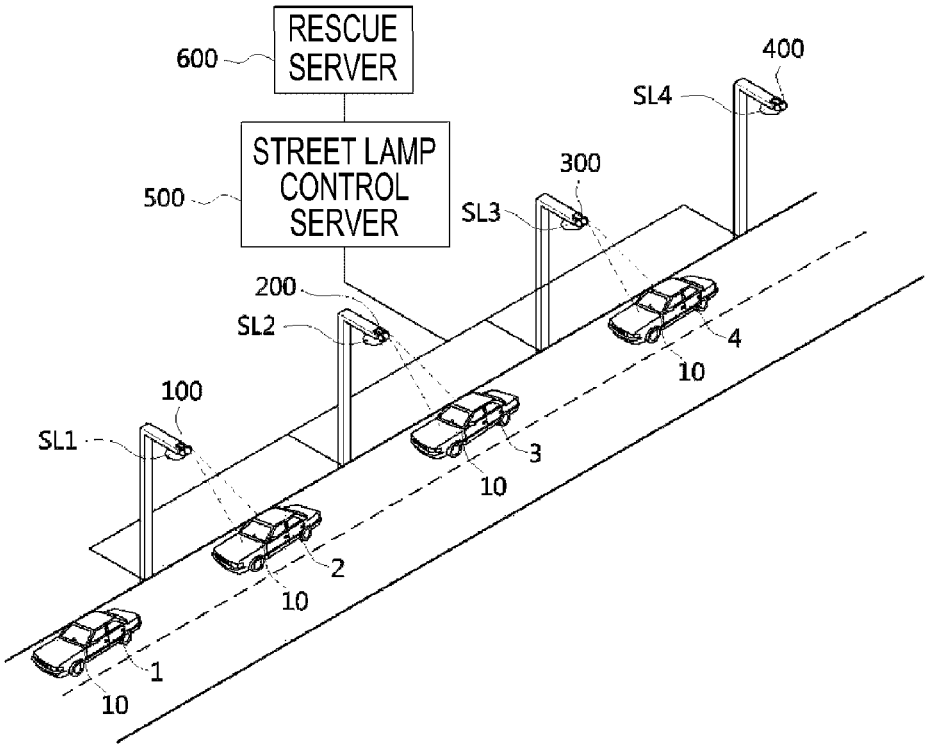
FIG. 1 is a view illustrating a configuration of a traffic accident occurrence notification system using an LED indicating lamp according to an embodiment of the present disclosure.

FIG. 1 is a view illustrating a configuration of a traffic accident occurrence notification system using an LED indicating lamp according to an embodiment of the present disclosure.

Referring to FIG. 1, a traffic accident occurrence notification system according to an embodiment of the present disclosure uses LED indicating lamps, and includes: a plurality of vehicles 1 to 4 that are mobile means, each of which includes an emergency message generating unit 10 that generates a wireless signal in an emergency situation; a plurality of LED indicating lamps 100 to 400 provided together with street lamps SL1 to SL4 provided on a road so as to receive the wireless signal from the emergency message generating unit 10 and to indicate a turned-on or flickering state from a position at which the wireless signal is received to a position at which a distance is set at a rear; and a street lamp control server 500 that controls the street lamps SL1 to SL4 and the LED indicating lamps 100 to 400, and determines the position at which the wireless signal is received so as to transmit information thereof to a rescue server 600.

Hereinafter, a configuration and an action of the traffic accident occurrence notification system that uses an LED indicating lamp according to an embodiment of the present disclosure and is configured as described above.

Hereinafter, a specific action of the present disclosure will be described assuming that an emergency situation occurs in a vehicle 1 for the convenience of description.

First, it is assumed that each of the vehicles 1 to 4, which travels on a road, includes an emergency message generating unit 10. The emergency message generating unit 10 is configured to send a wireless signal to notify occurrence of an emergency situation to the outside when the emergency message generating unit 10 directly detects that the emergency situation occurs, or when a driver or a passenger pushes a button.

In FIG. 1 and descriptions made with reference to FIG. 1, vehicles 1 to 4 traveling on a road are illustrated and described. However, it shall be understood that the term "vehicle" has a concept including two-wheeled vehicle or other mobile means. Further, it may also be understood that a case in which the emergency message generating unit 10 is directly carried may also be included.

Figure 2:
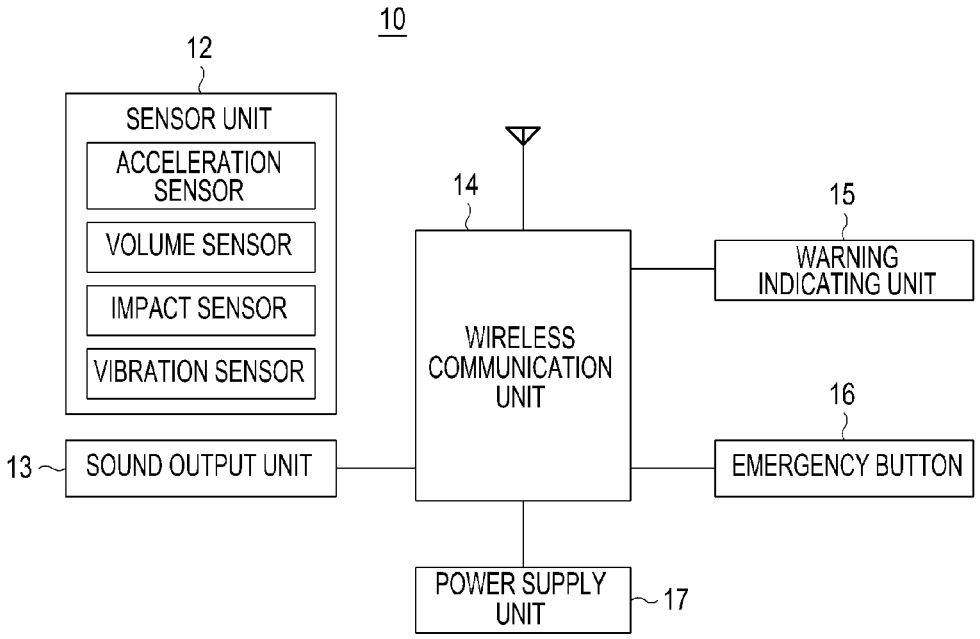
FIG. 2 is a block diagram of an emergency message generating unit 10 applied to an embodiment of the present disclosure.

FIG. 2 is a block diagram of an emergency message generating unit 10 applied to an embodiment of the present disclosure.

Referring to FIG. 2, the emergency message generating unit 10 applied to the present disclosure includes: a sensor unit 12 that senses an accident; an emergency button 16 that is selectable by a driver or a passenger when the driver or the passenger determines an emergency state; a wireless communication unit 14 configured to send a wireless signal to indicate an emergency situation when there is an abnormality occurrence signal from the sensor unit 12 or the selection of the emergency button 16, and to receive an external emergency situation wireless signal; a power supply unit 17 configured to supply a power to each of the units; and a sound output unit 13 and a warning indicating unit 15 that notifies that an emergency situation has occurred ahead or nearby upon receiving the wireless signal to indicate an emergency situation through the wireless communication unit 14.

The emergency situation may include an occurrence of a traffic accident, the driver's health abnormality, a crime situation in which the driver is threatened, and so on.

When the vehicle 1 rear-ends another vehicle or solely causes a traffic accident, the sensor unit 12 of the emergency message generating unit 10 mounted on the vehicle 1 senses that an accident occurs using various conditions.

The sensor unit 12 detects the acceleration, and when the speed is rapidly reduced, the sensor unit 12 determines it as an accident situation. Or, upon detecting a volume, which corresponds to a volume occurring in the event of an accident, by using a volume sensor, the sensor unit 12 determines it as an accident situation. In addition, the sensor unit 12 may include an impact sensor or a vibration sensor to directly detect an impact or vibration, and when an impact or vibration applied to the vehicle 1 is equal to, or higher than a reference value, the sensor unit 12 determines it as an accident situation.

Though the present embodiment has been described above with reference to the acceleration sensor, the volume sensor, the impact sensor, and the vibration sensor by way of an example, it is also possible to implement the present disclosure by using other sensing means. In addition, although the sensor unit 12 may be implemented by any one sensor, a person ordinarily skilled in the art may easily conceive that the sensor unit 12 may also be implemented by a combination of two or more sensors.

Meanwhile, when the sensor unit 12 does not operate due to a malfunction or any other reason in an accident, when a small accident occurs, or when a driver or a passenger of the vehicle 1 suffers from a health abnormality or is in a crime situation in which the driver or the passenger is threatened, the sensor unit 12 may not sense such situations, and thus the driver or the passenger may directly operate the emergency button 16.

In this way, according to the detection result of the sensor unit 12, or upon detecting the pushing of the emergency button 16, the wireless communication unit 14 transmits a preset emergency situation wireless signal to the outside.

An emergency lamp lighting button provided within the vehicle 1 may be used as the emergency button 16, or a separate button may be used as the emergency button 16. When the emergency lamp lighting button equipped in the vehicle 1 is used, it may be set such that, according to the pushing time thereof, the emergency lamp flickers or the occurrence of an emergency situation, at which it is necessary to transmit the above-mentioned wireless signal, is notified, which may be implemented through various methods, such as operating the emergency lamp lighting button once, operating the emergency lamp lighting button twice, providing a separate switch, and so on.

When a wireless signal is sent from the emergency message generating unit 10 of the vehicle 1 so as to notify an emergency situation as described above, the wireless signal is received by a wireless communication unit (not illustrated) provided on the street lamp SL1, and then the wireless communication unit of the street lamp SL1 controls a power supply unit (not illustrated), which is installed together with the street lamp SL1 so as to supply a power to the LED indicating lamp 100, thereby performing a control to cause the LED indicating lamp 100 to be turned on or flicker.

At this time, the wireless communication unit of the street lamp SL1 directly transmits a signal to a wireless communication unit that is provided to each of the street lamps SL2 to SL4 that are located on a rear side from the street lamp SL1 in the traveling direction of the vehicles 1 to 4 so as to control the LED indicating lamps 200 to 400 that are also provided together with the street lamps SL2 to SL4, respectively, such that the LED indicating lamps 200 to 400 are turned on or flicker.

Unlike this, a street lamp control server 500 may confirm the state in which the LED indicating lamp 100, which is provided together with the street lamp SL1, is turned on or flickers, and may control the LED indicating lamps 200 to 400, which are respectively provided to the other street lamps SL2 to SL4, to be turned on or flicker.

In the figure, it is illustrated that two street lamps SL2 and SL3 are positioned between the street lamps SL1 and SL4. However, more street lamps may be positioned between the street lamps SL1 and SL4, and the distance between the street lamps SL1 and SL4 may be 1 km to 3 km.

That is, the LED indicating lamps 100 to 400, which are located within a set distance rear side from a point where a vehicle accident or an emergency situation has occurred, can be turned on or flicker so as to make the drivers of the rearward vehicles 2 to 4 recognize that an accident has occurred ahead.

The LED indicating lamps 100 to 400 may be set such that the flickering speed of the LED indicating lamp 100, which is the closest to the point where the accident of the vehicle 1 or the emergency situation of the vehicle 1 has occurred, is relatively high, and the flickering speeds of the other LED indicating lamps 200 to 400 are gradually decreased as the distances from the position of the vehicle 1 are increased, which enables the rearward vehicles 2 to 4 to determine the distance from the point where the accident or the emergency situation has occurred through the flickering states of the LED indicating lamps 100 to 400.

As described above, according to the present disclosure, when an emergency situation such as accidents of the vehicle 1 has occurred, the vehicles 2 to 4 following the vehicle 1 can be made to recognize that the accident or the emergency situation has occurred ahead, thereby preventing the occurrence of a secondary accident.

Figure 3:
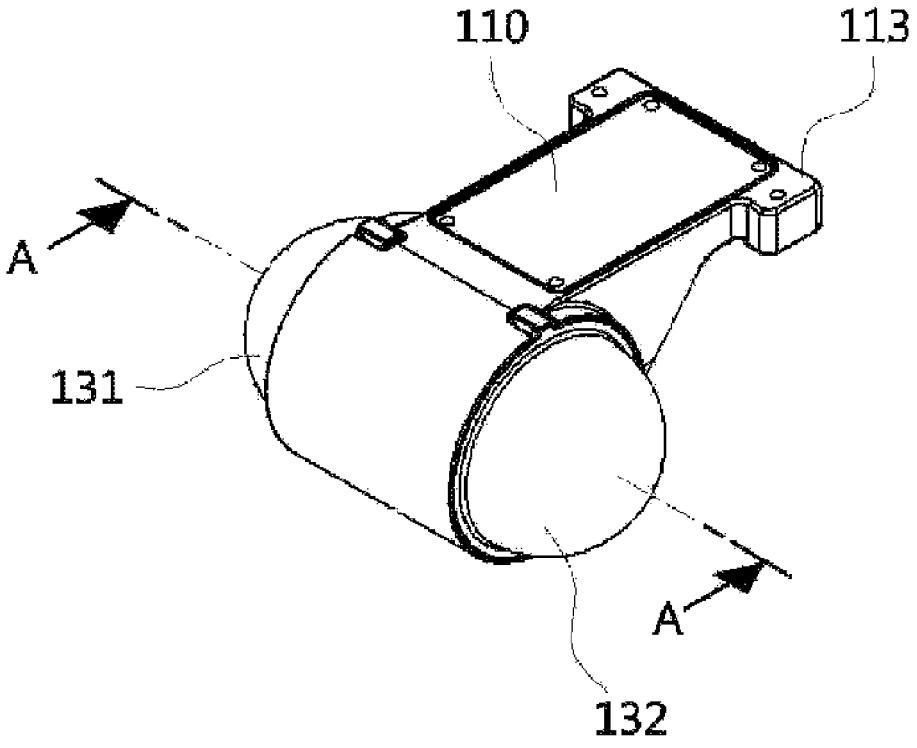
FIG. 3 is a perspective view of the LED indicating lamp 100 according to an embodiment of the present disclosure.
Figure 4:
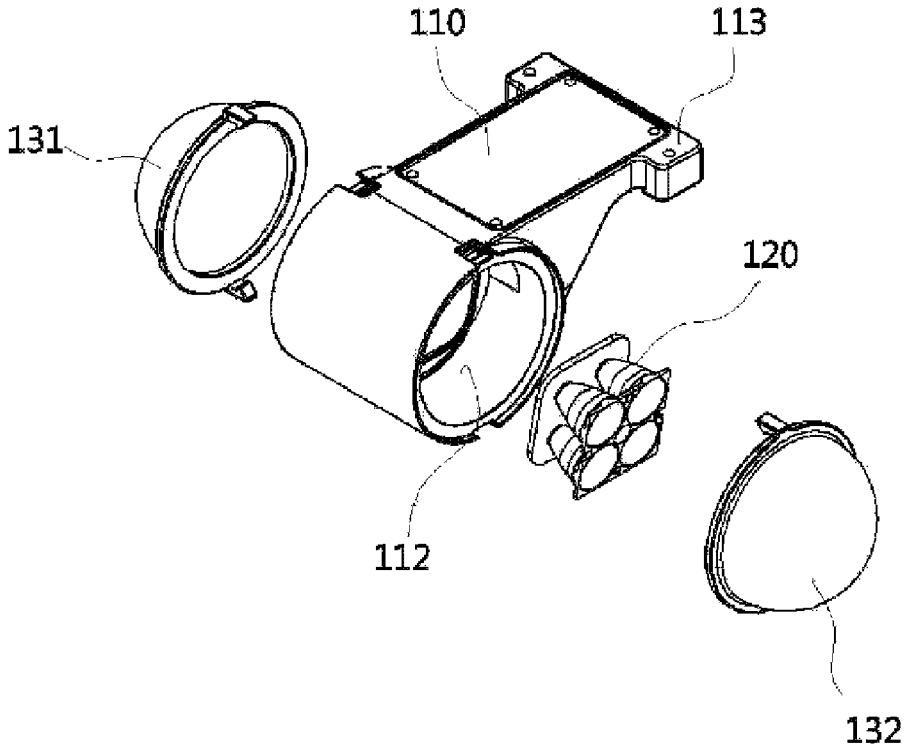
FIG. 4 is an exploded perspective view of the LED indicating lamp of FIG. 3.
Figure 5:
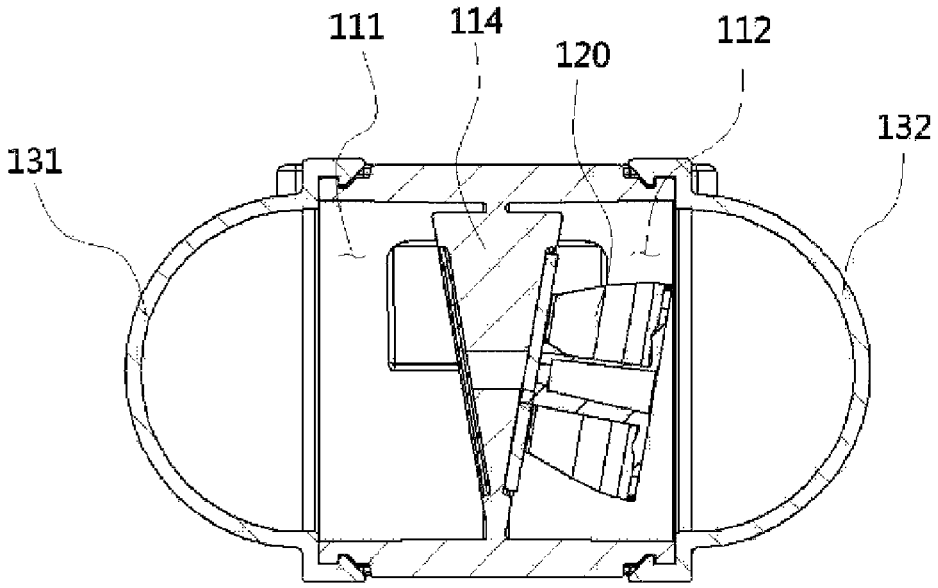
FIG. 5 is a cross-sectional view of taken along line A-A in FIG. 3.

FIG. 3 is a perspective view of the LED indicating lamp 100 according to an embodiment of the present disclosure, FIG. 4 is an exploded perspective view of the LED indicating lamp of FIG. 3, and FIG. 5 is a cross-sectional view of taken along line A-A in FIG. 3.

Referring to FIGS. 3 to 5, the LED indicating lamp 100 of the present disclosure includes: a body 110 that includes two accommodation parts 111 and 112, each of which has a light emission port, on the left and right sides of a partition wall 114, and a fastening part 113 that extends in one direction from the portion between the accommodation parts 111 and 112 to be fastened to a street lamp; an optical module 120 that is inserted into the accommodation part 112, which is located at the rear side in the traveling direction to be opposite to the accommodation part 111; and covers 131 and 132 that cover the light emission ports of the accommodation parts 111 and 112, respectively.

The constitution further including the accommodation part 111 is configured in consideration of the countries in which a vehicle traveling direction is defined to be opposite to that in Korea, such as Japan and England, such that, when the LED indicating lamp 100 is exported to any of the corresponding countries, it can be used by mounting the optical module 120 in the accommodation part 111.

Because the light emitting lamp 100 is oriented opposite to the traveling direction (i.e., because the light emitting lamp 100 faces a vehicle at the rear side), the LED indicating lamp 100 is excellent in visibility, and is capable of reducing power consumption as compared to a type that causes a street lamp to be turned on or to flicker in the conventional manner In particular, as compared to a case in which a street lamp that mainly illuminates a road is caused to be turned on or flicker, the type that controls a separate LED indicating lamp 100 as in the present embodiment has an advantage in that an emergency situation may be notified more safely.

The configuration of the LED indicating lamp 100 is an example, and may be modified into various types of indicating lamps.

The example described above is related to a case in which a situation in which an accident has occurred ahead is notified to rearward vehicles through the LED indicating lamps 100 to 400. In the present disclosure, the LED indicating lamps 100 to 400 may directly notify the emergency message generating unit 10 within each vehicle of the situation.

When the wireless signal is generated from the wireless communication unit 14 of the emergency message generating unit 10 as described above, each of the LED indicating lamps 100 to 400 is turned on or flickers as described above, and the street lamp control server 500 outputs a control signal to notify the emergency message generating units 10 of the other vehicles of this situation. Based on the received signal, it can be recognized that an accident has occurred ahead, which may be notified to a driver through the sound output unit 13.

In addition, it is possible to visually show a driver that an abnormality has occurred in the forward vehicle 1 by causing the warning indicating unit 15 to flicker.

Accordingly, the present disclosure can prevent a secondary accident in which a rearward vehicle rear-ends a forward vehicle in the accident through the LED indicating lamps 100 to 400. Further, the emergency message generating unit 10 installed in the vehicle 1 is also capable of notifying the drivers of the other vehicles that an emergency situation has occurred ahead through the sensor output unit 13 and/or the warning indicating unit 15.

By performing duplicate notification of an emergency situation as described above, it is possible to notify the rearward vehicles of the occurrence of an emergency situation more correctly.

Meanwhile, simultaneously with preventing the secondary accident, the position information of the vehicle 1 that has sent the wireless signal is transferred to the street lamp control server 500.

Due to this, even though the emergency message generating unit 10 equipped in the vehicle 1 is not provided with a separate GPS device, it is possible to easily and correctly detect the position of the vehicle 1 in the emergency situation based on the position of the street lamp that has received the wireless signal because the street lamp control server 500 stores the position information of each of the street lamps SL1 to SL4.

The street lamp control server 500 provides accident occurrence information and accident occurrence position information to a rescue server 600 that is provided in a fire station or a police station, and the rescue server 600 may arrange a recovery vehicle and an ambulance to the corresponding position.

As described above, according to the present disclosure, an emergency situation such as an accident, or the like can be detected and the detected position can be automatically notified to a 119 rescue center or the like such that it is possible to efficiently deal with the accident or the like.

The present disclosure provides the emergency message generating unit in a vehicle so as to detect an accident or enable a driver to select propagation of an emergency situation upon recognizing an emergency situation. When the emergency message generating unit sends a wireless signal, the street lamp controller therearound receives the wireless signal to cause the LED indicating lamps, which are located within a distance set rearward from the corresponding position, to be turned on or flicker, so as to make a driver in a rearward vehicle recognize the occurrence of the emergency situation ahead, thereby preventing the occurrence of a secondary collision accident.

In addition, when the wireless signal of the emergency message generating unit is received by the emergency message generating unit provided in the rearward vehicle, the driver of the rearward vehicle can be guided to drive slowly, thereby preventing the occurrence of a secondary accident.

Further, according to the present disclosure, because the wireless signal is received from the emergency message generating unit to confirm the position of the emergency message generating unit, it is possible to automatically notify an ambulance and a recovery vehicle of a correct accident position.

To a person ordinarily skilled in the art to which the present disclosure belongs, it is evident that the present disclosure is not limited to the above-described embodiments, and various modifications and variations can be made within the scope of the present disclosure without departing from the technical idea of the present disclosure.

The invention claimed is:

1. A traffic accident occurrence notification system using LED indicating lamps, the system comprising:

an emergency message generating unit (10) that is provided in a mobile means to generate a wireless signal in an emergency situation;

a plurality of LED indicating lamps (100 to 400), which are provided together with street lamps SL1 to SL4 provided on a road, to receive the wireless signal from the emergency message generating unit (10), and to indicate a turned-on or flickering state within a distance that is set rearward from a position where the wireless signal is received; and a street lamp control server (500) that controls the street lamps (SL1 to SL4) and the LED indicating lamps (100 to 400), and determines a position where the wireless signal is received so as to transmit information thereof to a rescue server (600), wherein the LED indicating lamps flicker upon receiving the wireless signal from the emergency message generating unit, and a flickering speed of the LED indicating lamp, which is closest to a position where the wireless signal is generated, and flickering speeds of the other LED indicating lamps are gradually decreased as the distance from the position.

2. The system of claim 1, wherein the emergency message generating unit includes:

a sensor unit (12) that detects an accident or an emergency situation;

an emergency button (16) that is selected by a driver or a passenger who determines an emergency situation;

a wireless communication unit (14) that sends a wireless signal indicating an emergency situation when the sensor unit (12) outputs a signal or when the emergency button (16) is selected, and receives an external emergency situation wireless signal;

a power supply unit that supplies power to each of the emergency unit, the sensor unit, the emergency button, and the wireless communication unit; and a sound output unit (13) and a warning indicating unit (15) that notify that an emergency situation has occurred ahead upon receiving the wireless signal indicating an emergency situation through the wireless communication unit.

3. The system of claim 2, wherein the sensor unit (12) includes at least one of an acceleration sensor, a volume sensor, an impact sensor, and a vibration sensor.

4. The system of claim 1, wherein each of the LED indicating lamps includes:

a body (110) that includes two accommodation parts (111, 112), each of which has a light emission port, on the left and right sides of a partition wall (114), and a fastening part (113) that extends in one direction from a portion between the accommodation parts (111, 112) to be fastened to a street lamp;

an optical module (120) that is inserted into the accommodation part (112), which is located at an rear side in the traveling direction to be opposite to the accommodation part 111; and covers (131, 132) that cover the light emission ports of the accommodation parts (111, 112), respectively.

5. The system of claim 2, wherein the emergency button is an emergency lamp lighting button that is provided within a vehicle.

* * * * *